United States Patent [19]

Habermann

[11] Patent Number: 4,927,105

[45] Date of Patent: May 22, 1990

[54] CONVERTIBLE LEG/ROLLER STRUCTURE

[76] Inventor: Patrick R. Habermann, 750 Conn Valley Rd., St. Helena, Calif. 94574

[21] Appl. No.: 296,813

[22] Filed: Jan. 12, 1989

[51] Int. Cl.[5] ..... A47B 91/00

[52] U.S. Cl. ..... 248/188.8; 16/19

[58] Field of Search ..... 248/188.8, 188.9; 280/43.24, 43.2; 182/17; 16/34, 19, 32, 33

[56] References Cited

U.S. PATENT DOCUMENTS

| | | | |
|---|---|---|---|
| 1,058,837 | 4/1913 | Zikmund | 16/34 |
| 2,009,918 | 7/1935 | Grassi | 280/43.24 |
| 2,097,349 | 10/1937 | Sladek | 16/33 X |
| 2,446,518 | 8/1948 | Arnold et al. | 280/43.24 |
| 2,490,953 | 12/1949 | Eriksen | 16/33 |
| 2,768,835 | 10/1956 | Hull | 280/43.24 |
| 3,934,304 | 1/1976 | Takahashi | 16/34 |

*Primary Examiner*—J. Franklin Foss

*Attorney, Agent, or Firm*—Flehr, Hohbach, Test, Albritton & Herbert

[57] ABSTRACT

Convertible leg/roller structure for supporting an easel or other object in either a stationary position or a movable position. The leg can be moved to position either a stationary pad or a roller in contact with the ground or other supporting surface. A latch is provided for locking the leg in one of these two positions.

11 Claims, 2 Drawing Sheets

CONVERTIBLE LEG/ROLLER STRUCTURE

This invention pertains generally to support structures for easels and the like, and more particularly to a convertible leg/roller structure for supporting an easel or another object in either a stationary position or a movable position.

Ser. No. 050,329, filed Mar. 18, 1987, now abandoned, discloses an expandable easel assembly for holding workpieces of many different sizes in a variety of different positions. This easel assembly has a pair of upright posts with horizontally extending base members at the lower ends thereof. The base members have ground engaging wheels and pads toward opposite ends thereof, and the easel assembly can be moved by tilting it to disengage the pads from the ground or floor and rolling it on the wheels. Moving the easel in this manner can be awkward, particularly when large workpieces are mounted on it, and there is a chance that it may fall when it is tilted.

In order to improve stability, wheeled supporting structures have heretofore been provided with locks for the wheels or means for lifting the wheels off the floor or other supporting surface when the structure is in a stationary position. Examples of such structures are found in U.S. Pat. Nos. 2,354,906 and 3,534,974. With these structures, it is generally necessary to lift the entire structure in order to disengage or engage the wheels.

It is in general an object of the invention to provide a new and improved structure for supporting an easel or another object in a stationary position or a movable position.

Another object of the invention is to provide a supporting structure of the above character which overcomes the limitations and disadvantages of structures heretofore provided.

Another object of the invention is to provide a supporting structure of the above character in which it is not necessary to raise the easel or other object supported thereby in changing between fixed and movable positions.

These and other objects are achieved in accordance with the invention by providing a convertible leg/roller structure having a pivotally mounted leg movable between horizontal and vertical positions, a surface at one end of the leg for engagement with a supporting surface when the leg is in the vertical position, and a roller mounted on one side of the leg for engagement with the supporting surface when the leg is in the horizontal position. The leg pivots about an axle spaced equally from the portions of the leg and the roller which engage the supporting surface so that it is not necessary to lift the structure in order to move between the stationary and movable positions. A latch is included for locking the leg in at least one of the positions.

Figure 1:
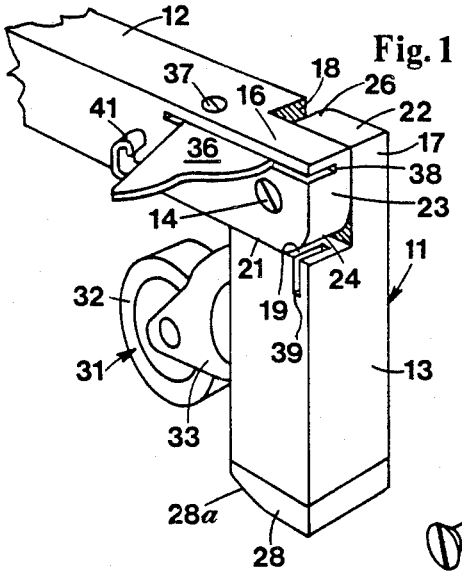
FIG. 1 is a fragmentary isometric view of one embodiment of a convertible leg/roller structure according to the invention.

In FIG. 1, the leg/roller structure 11 is illustrated in connection with a horizontally extending leg or base member 12 of an object such as an easel assembly of the type shown in Ser. No. 050,329, filed Mar. 18, 1987, now abandoned. The base member has a generally rectangular cross-section, and it is fabricated of a rigid material such as wood, metal or a suitable plastic.

Leg structure 11 includes a relatively short leg 13 which is likewise fabricated of a rigid material and has a generally rectangular cross-section. The inner end portion of leg 13 is pivotally connected to the outer end portion of base member 12 for movement about a horizontally extending axis between vertical and horizontal positions. The leg is shown in the vertical position in FIG. 1 and in the horizontal position in FIG. 2. In this embodiment, a screw 14 secures the end portions of the leg and base member together and serves as a pin or axle for the pivotal connection.

The outer end portion of base member 12 and the inner end portion of leg 13 are dovetailed together so that the leg forms a substantially continuous extension of the base member in the horizontal position. In this regard, the base member and leg have tenons 16, 17 which are offset on opposite sides of the respective members and positioned side by side with the pivot pin extending through them. Base member 12 has a shoulder 18 adjacent to tenon 16, and leg 13 has a similar shoulder 19 adjacent to tenon 17. These shoulders serve as limiting abutments for the leg in the horizontal and vertical positions. When the leg is in the vertical position, the side of the leg abuts against shoulder 18, and shoulder 19 abuts against the lower side 21 of the base member. When the leg is in the horizontal position, the inner end 22 of the leg abuts against shoulder 18, and shoulder 19 abuts against the outer end 23 of the base member. The corners 24, 26 of the tenons are rounded to clear shoulders 19, 18, respectively, as the leg is moved between the vertical and horizontal positions.

Figure 3:
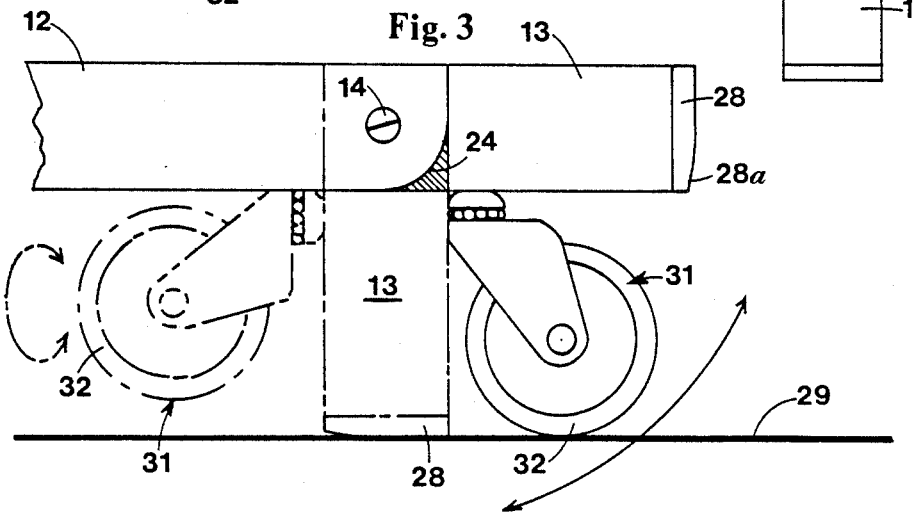
FIG. 3 is a side elevational view of the embodiment of FIG. 1, showing the leg and roller in different operating positions.

A fixed pad 28 is mounted on the outer end of leg 13 for engagement with the floor 29 (FIG. 3) or another suitable supporting surface when the leg is in the vertical position.

A caster 31 is mounted on the side of leg 13 which faces in a downward direction when the leg is in the horizontal position. The caster comprises a wheel or roller 32 which is rotatively mounted in a swivel frame 33 for engagement with the floor or other supporting surface when the leg is in the horizontal position.

The dimensions of leg 13 and caster 31 are such that base member 12 and the easel or other object supported thereby are the same distance above the floor or other supporting surface whether the object is supported in a fixed position on the pad or in a movable position on the roller. Otherwise stated, the distance from screw 14 to the outer surface of pad 28 is the same as the vertical distance from the horizontal plane of the pin to the lower periphery of the roller when the leg is in the horizontal position. The corner of pad 28 closest to wheel 32 is rounded as illustrated at 28*a* to facilitate movement onto and off of the pad without a rocking motion as this portion of the pad engages the floor.

Figure 2:
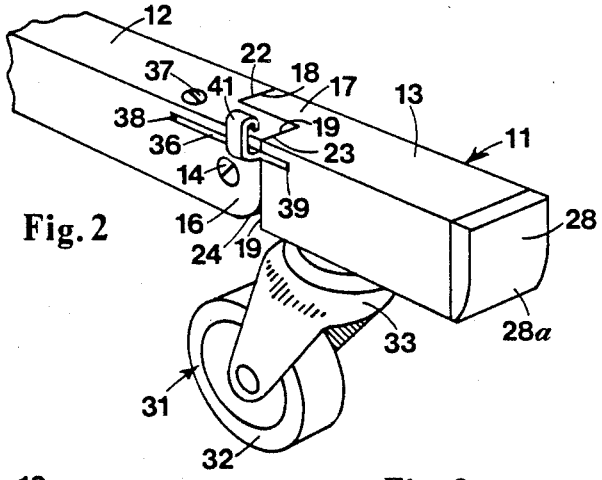
FIG. 2 is a fragmentary isometric view of the embodiment of FIG. 1 in a different operating position.

Means is provided for locking leg 13 in the horizontal position. This means includes a latch plate 36 which is pivotally mounted on a screw 37 for movement between locked and unlocked positions in a horizontally extending slot 38 in the end portion of base member 12. A corresponding slot 39 is formed in the end portion of leg 13 and is aligned with slot 38 when the leg is in the horizontal position. In this position, latch plate 36 can be swung into the slots to lock the leg into the base member, as illustrated in FIG. 2. The latch plate has a spring clip 41 which engages the upper surface of tenon 16 to hold the plate in the locking position.

Operation and use of the leg/roller structure is as follows. The structure can be used to support an easel or other structure which needs to be moved from one stationary position to another. It is assumed that the easel or other object has a pair of horizontally extending base members similar to base member 12 and that a leg/roller assembly 11 is provided at each end of each of the base members.

When the easel is to be used in a stationary position, legs 13 are moved to their vertical positions so that pads 28 engage the floor or other supporting surface and the legs and the easel rest upon the pads.

To move the easel, legs 13 are swung to the horizontal position to bring rollers 32 into engagement with the floor or other supporting surface. As each of the legs is moved away from the vertical position, the roller mounted thereon engages the floor or supporting surface, and the load carried by the leg is transferred to the roller. As the leg continues its movement toward the horizontal position, the roller rolls on the floor and carries the load without appreciable deflection of the easel or the base structure. When the leg is in the horizontal position, lock plate 36 is pivoted into the slots and clip 41 is engaged with the upper surface of tenon 16 to hold the leg in this position. When the easel is resting upon the wheels, it can be rolled over the floor or other supporting surface as desired.

To return to the stationary position, clip 41 is disengaged from tenon 16, and lock plate 36 is swung out of slot 39. Leg 13 is then swung in a downward direction, rolling on roller 32 as the load is transferred from the roller to the pad at the end of the leg.

Figure 4:
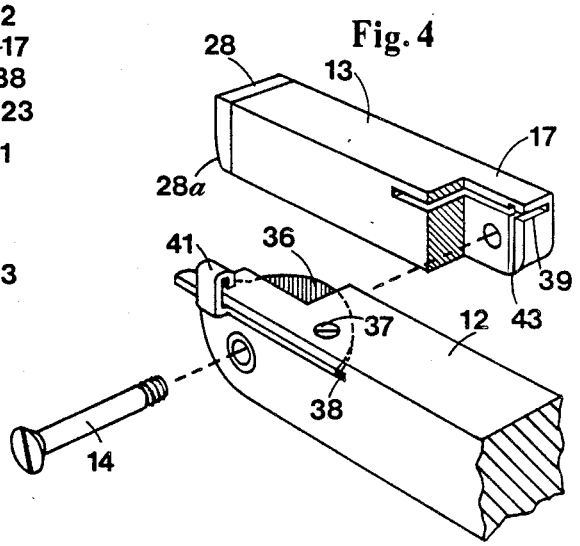
FIG. 4 is an exploded isometric view of another embodiment of a convertible leg/roller structure according to the invention.

The embodiment illustrated in FIG. 4 is generally similar to the embodiment of FIG. 1, and like reference numerals designate corresponding elements in the two embodiments. In FIG. 4, caster 31 has been omitted for ease of illustration, but it will be understood that the caster is mounted on leg 13 just as it is in the embodiment of FIG. 1.

In the embodiment of FIG. 4, an additional slot 43 is provided for locking the leg in the vertical position. The additional slot is formed in the tenon portion 17 of the leg, and it is perpendicular to slot 39 so that it is aligned with lock plate 36 and slot 38 when the leg is in the vertical position.

Operation and use of the embodiment of FIG. 4 is similar to that previously described. However, in this embodiment, leg 13 can be locked in the vertical position by engaging lock plate 36 with slot 43.

Figure 5:
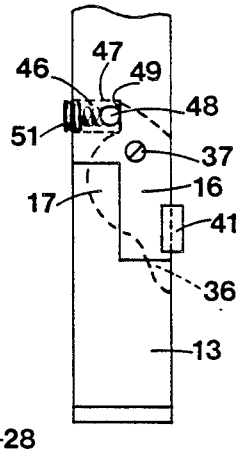
FIG. 5 is a fragmentary top plan view, partly broken away, of another embodiment of a convertible leg/roller structure according to the invention.

The embodiment of FIG. 5 is generally similar to the other embodiments, and like reference numerals designate corresponding elements in this embodiment as well.

The embodiment of FIG. 5 includes means for yieldably urging lock plate 36 toward the locking position. This means includes a coil spring 46 mounted in a bore 47 in alignment with slot 38 in base member 12. A ball 48 at the inner end of the bore bears against a tang 49 at the inner end of the lock plate, and a set screw 51 is threadedly mounted in the bore behind the spring to adjust the amount of force exerted by the spring.

As viewed in FIG. 5, spring 46 urges lock plate 36 to pivot in a clockwise direction about screw 37 toward the locking position. The lock plate can be disengaged from the slot or slots in leg 13 by rotating the plate in a counterclockwise direction against the force of the spring. When the plate is released, it is returned by the spring to the locking position.

Figure 6:
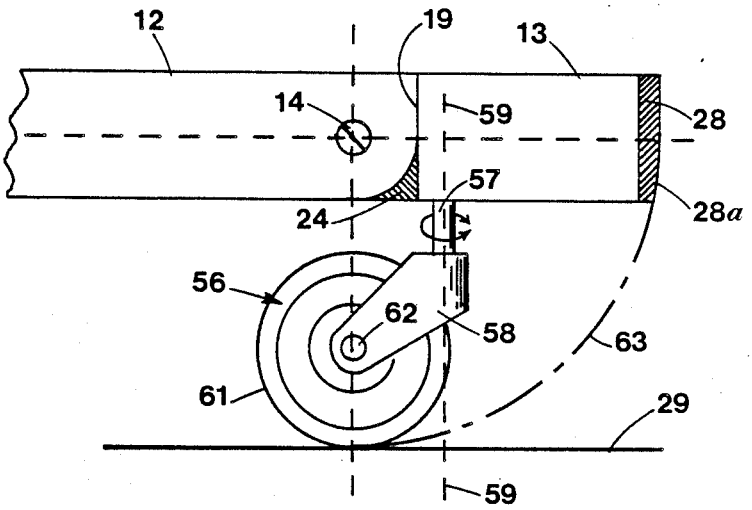
FIGS. 6 and 7 are fragmentary side elevational views of another embodiment of a convertible leg/roller structure according to the invention, showing the structure in two different operative positions.
Figure 7:
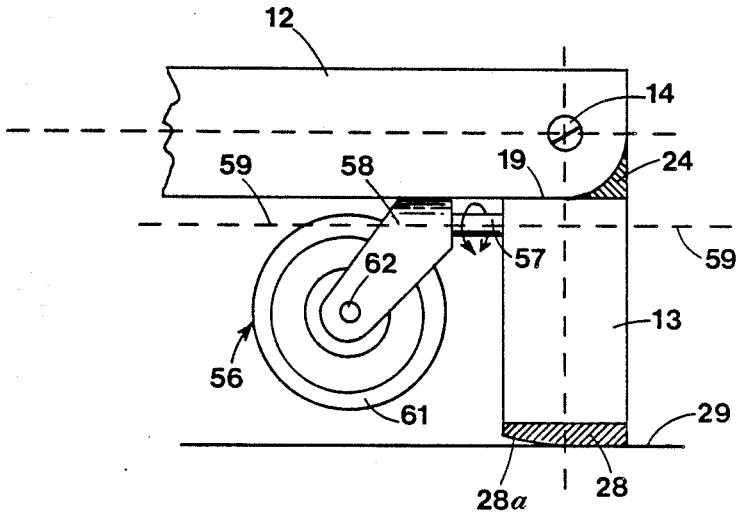

The embodiment illustrated in FIGS. 6–7 is generally similar to the other embodiments, and like reference numerals designate corresponding elements in this embodiment as well. The embodiment of FIGS. 6–7 differs from the others in that caster 56 has a shaft 57 on which swivel frame 58 is mounted. Shaft 57 is mounted on the side of leg 13 which faces in a downward direction when the leg is in the horizontal position, and frame 58 swivels about an axis 59 perpendicular to the axis of the leg. In other words, frame 58 swivels about a vertical axis when the leg is in the horizontal position and about a horizontal axis when the leg is in the vertical position. A roller or wheel 61 is mounted on an axle 62 which extends between the arms of frame 58 in a direction perpendicular to axis 59.

In this embodiment, the roller axis (the axis of axle 62) is offset from the swivel axis (the axis of shaft 57), and the roller axis is positioned vertically beneath pivot screw 14 when the leg is in the horizontal position and the caster is positioned as shown in FIG. 6. The point of contact between roller 61 and floor 29 lies on an arc 63 which is centered about the axis of screw 14. The curved surface **28*a* on the pad at the end of leg 13 also lies on this arc to assure a smooth transition between the roller and the pad as the leg is moved between its horizontal and vertical positions. As the leg is moved toward the vertical position, caster 56 swivels by gravity to the position shown in FIG. 7 to clear the underside of base member 12**.

In the embodiment of FIGS. 6–7, base member 12 and the load carried thereby are positioned the same distance above the floor whether the structure is resting upon roller 61 or pad 28. With the periphery of the roller and the curved surface of the pad lying on an arc centered about the axis of pivot screw 14, there is no rocking motion or change in height as the leg is moved between the horizontal and vertical positions and the load is transferred between the wheel and the pad.

It is apparent from the foregoing that a new and improved convertible leg/roller structure has been provided for easels and other objects. While only certain presently preferred embodiments have been described in detail, as will be apparent to those familiar with the art, certain changes and modifications can be made without departing from the scope of the invention as defined by the following claims.

I claim:

1. In a convertible leg/roller structure for supporting an object: a pivotally mounted leg movable about an axis between vertical and horizontal positions, a surface at one end of the leg for engagement with a supporting surface when the leg is in the vertical position, and a roller mounted on one side of the leg for engagement with the supporting surface when the leg is in the horizontal position, the surface at the end of the leg and the portion of the roller which engages the supporting surface lying on an arc centered about the axis so that leg can be moved between the vertical and horizontal positions to engage either the surface at the end of the leg or the roller with the supporting surface without lifting the object.

2. The structure of claim 1 including means for locking the leg in one of the positions.

3. The structure of claim 2 wherein the means for locking the leg comprises a latch engageable with the leg when the leg is in the one position.

4. The structure of claim 1 including means for locking the leg in the horizontal position.

5. The structure of claim 4 wherein the means for locking the leg comprises a latch member rotatable about a vertically extending axis and engageable with a slot in the leg.

6. The structure of claim 5 wherein the leg has a second slot perpendicular to the first named slot for receiving the latch member in locking engagement when the leg is in the vertical position.

7. In a support structure: an axially elongated horizontally extending base member, a leg member pivotally mounted on the base for movement about a horizontally extending axis between a vertical and a horizontal position in which the leg member is aligned axially with the base member, a surface at one end of the leg member for engagement with a horizontal supporting surface when the leg is in the vertical position, a roller rotatively mounted on one side of the leg member for rolling engagement with the supporting surface when the leg is in the horizontal position, axially extending slots formed in the base member and in the leg member for alignment with each other when the leg member is in the horizontal position, and a latch pivotally mounted on one of the members for movement into the aligned slots to lock the leg member in the horizontal position.

8. The structure of claim 7 wherein the latch is pivotally mounted for movement about a vertically extending axis.

9. The structure of claim 7 wherein the base member and the leg member have surfaces which abut against each other when the leg member is in the vertical and horizontal positions.

10. The structure of claim 7 wherein one of the members has a second slot perpendicular to the first slot formed therein, the second slot being aligned with the slot in the other member when the leg member is in the vertical position.

11. In a structure for supporting an object in stationary and movable positions: a leg pivotally connected to the object for movement about a horizontally extending axis between vertical and horizontal positions, a pad at one end of the leg for engagement with a supporting surface when the leg is in the vertical position, a swivel frame mounted on one side of the leg for rotation about a swivel axis which is perpendicular to the leg, and a roller mounted on the swivel frame for engagement with the supporting surface for rotation about an axis which is perpendicular to and offset from the swivel axis.

* * * * *